US009264829B2

(12) United States Patent
Tsai

(10) Patent No.: US 9,264,829 B2
(45) Date of Patent: Feb. 16, 2016

(54) DEVICE AND METHOD FOR DETECTING FORCE FACTOR OF LOUDSPEAKER

(71) Applicant: RICHTEK TECHNOLOGY CORP, Hsinchu (TW)

(72) Inventor: Kuo Shih Tsai, Hsinchu (TW)

(73) Assignee: RICHTEK TECHNOLOGY CORP, Hsinchu (TW)

( * ) Notice: Subject to any disclaimer, the term of this patent is extended or adjusted under 35 U.S.C. 154(b) by 148 days.

(21) Appl. No.: 14/302,680

(22) Filed: Jun. 12, 2014

(65) Prior Publication Data

US 2015/0208189 A1 Jul. 23, 2015

(30) Foreign Application Priority Data

Jan. 23, 2014 (TW) ..... 103102385 A

(51) Int. Cl.
*H04R 29/00* (2006.01)
*H04R 3/04* (2006.01)

(52) U.S. Cl.
CPC ..... *H04R 29/001* (2013.01); *H04R 3/04* (2013.01)

(58) Field of Classification Search
CPC ..... H04R 29/001; H04R 3/04; H04R 29/00
USPC ..... 381/59, 58, 96, 98
See application file for complete search history.

(56) References Cited

U.S. PATENT DOCUMENTS

2015/0124982 A1 * 5/2015 Berthelsen ..... H04R 29/001 381/59

* cited by examiner

*Primary Examiner* — Paul S Kim
(74) *Attorney, Agent, or Firm* — Chun-Ming Shih

(57) ABSTRACT

A method and device for detecting a force factor of a loudspeaker is provided. The method includes the steps of: providing the loudspeaker with a dynamic driving voltage signal; continuously measuring a current signal flowing through the loudspeaker; observing the current signal and if the current signal shows that the diaphragm excursion of the loudspeaker is greater than an displacement limit, decreasing the driving voltage signal until the current signal shows that the diaphragm excursion of the loudspeaker is less than or equal to the displacement limit; and substituting the current driving voltage signal, the current signal, the displacement limit, and an electrical impedance of the loudspeaker into a function so as to compute the force factor of the loudspeaker.

20 Claims, 5 Drawing Sheets

DEVICE AND METHOD FOR DETECTING FORCE FACTOR OF LOUDSPEAKER

CROSS REFERENCE TO RELATED APPLICATIONS

This non-provisional application claims priority claim under 35 U.S.C. §119(a) on Taiwan Patent Application No. 103102385 filed Jan. 23, 2014, the entire contents of which are hereby incorporated by reference.

BACKGROUND

1. Field of the Invention

The present invention relates to a device and method for detecting a force factor of a loudspeaker and, more particularly, to a device and method that are utilized by end users so as to accurately detect the force factor of a loudspeaker.

2. Description of Related Art

To protect the physical structure of a loudspeaker from being permanently damaged, it is a practice not to directly drive a loudspeaker with a linearly-amplified audio signal, which may, if the driving signal is too large, cause greater diaphragm excursion or even exceed beyond the displacement limit of the diaphragm excursion, thus leading to a change in the property, or a shorter lifetime, of the diaphragm of the loudspeaker, or even direct damage to the structure of the diaphragm. On the other hand, to have better listening experience, one may put the output volume of the loudspeaker to its limit, which may stress the diaphragm excursion of the loudspeaker to the displacement limit. Therefore, it has become an issue of the design of a loudspeaker and its driving circuit on how to detect, or predict, the diaphragm excursion so as to make an optimal tradeoff between the output volume and the protection of the loudspeaker.

FIG. 1 shows an equivalent circuit diagram of a prior-art loudspeaker 100 having two terminal inputs 110. By applying a driving voltage u at the two terminal inputs 110, the diaphragm of the loudspeaker 100 is induced to vibrate so as to generate human-perceivable sound waves. In the equivalent circuit of the loudspeaker 100, the circuit of the electrical impedance and the back electromotive force (BEMF) parallels the aspect of the electrical property of the loudspeaker 100, while the circuit of the electromagnetic force, mechanical impedance and saturation electromagnetic force parallels the aspect of the mechanical property of the loudspeaker 100.

The driving voltage u at the terminal inputs 110 forms a current i. In the aspect of the mechanical property of the loudspeaker 100, an electromagnetic force with a magnitude of $\Phi*i$ is formed due to the induction caused by the current i, where $\Phi$ is the force factor, which is a characteristic parameter of the loudspeaker, and the electromagnetic force causes a velocity of displacement v on the diaphragm of the loudspeaker with a mechanical impedance Zm. The saturation electromagnetic force is the part of the induced electromagnetic force when the diaphragm excursion of the loudspeaker 100 is close to or greater than the displacement limit. The magnitude of the saturation electromagnetic force is $M*v'$, where $v'$ is the first derivative of the velocity of displacement v, and the coefficient M is approaching zero when the diaphragm excursion is at a low value. The parameters described hereto can be related by the equation as follows:

$$\Phi \cdot i = Zm \cdot v + M \cdot V \quad (1)$$

The function of the velocity of displacement v can be derived from Eq. (1). As shown in FIG. 1, the equivalent circuit has a BEMF with magnitude of $\Phi*v$ and indicates that the driving voltage u is not fully applied on the electrical impedance Ze; instead, the mechanical aspect of the loudspeaker generates a voltage of the BEMF with magnitude of $t*v$, where the voltage is connected to the electrical impedance Ze in series. Therefore, with the known driving voltage u, one can obtain the magnitude of the BEMF $\Phi*v$ by measuring the current i. However, the diaphragm excursion (i.e., the integral of the velocity of displacement v) cannot be obtained without first computing the magnitude of the force factor $\Phi$.

During the warm-up calibration of the loudspeaker 100, one can detect the magnitude of the force factor $\Phi$ by performing a reverse computation on the diaphragm excursion x of the loudspeaker 100 when operating at the displacement limit. In the prior art, there exist two approaches to check how close the diaphragm excursion is to the displacement limit. One approach is to analyze the electrical signal, for example, the driving voltage u or the total harmonic distortion (THD) of the current i. When the diaphragm excursion x of the loudspeaker 100 is close to or greater than the displacement limit, however, the THD measured by an electrical signal may not be distinguishable because most of the non-linearity of the loudspeaker 100 occur in the resonant frequency, but not in the harmonic frequency of the electrical signal. The other approach is to analyze the THD on the sound pressure level (SPL) generated by the loudspeaker. The THD on SPL is more distinguishable, but the measurement of the SPL is only feasible under a controlled environment, and therefore the measurement is conducted in the lab or a factory. Besides, the measurement of the SPL requires some special instruments, which may not be easily accessible to the end users.

SUMMARY

In view of the foregoing, a device and method for detecting a force factor of a loudspeaker are provided. More particularly, a method and device that are utilized by end users so as to accurately detect the force factor of a loudspeaker are provided.

The present invention provides a method for detecting a force factor of a loudspeaker. The method includes the steps of: providing a loudspeaker with a dynamic driving voltage signal; continuously measuring a current signal flowing through the loudspeaker; observing the current signal and if the current signal shows that a diaphragm excursion of the loudspeaker is greater than an displacement limit, decreasing the driving voltage signal provided to the loudspeaker until the current signal shows that the diaphragm excursion of the loudspeaker is less than or equal to the displacement limit; and substituting the current driving voltage signal, the current signal, the displacement limit, and an electrical impedance of the loudspeaker into a function so as to compute a force factor of the loudspeaker.

In one embodiment of the present invention, the step of observing the current signal further includes the step of observing if the oscillating amplitude of the second derivative of the current signal is greater than a predetermined value and if the oscillating amplitude is greater than the predetermined value, the diaphragm excursion of the loudspeaker is deemed to be greater than the displacement limit, and where the predetermined value is positively related to the magnitude of the driving voltage signal.

The present invention also provides a device for detecting a force factor of a loudspeaker. The device includes: a driving circuit, coupled to a loudspeaker, for receiving a control signal and generating a dynamic driving voltage signal; a current sensing unit, coupled to a loudspeaker, for continuously measuring a current flowing through the loudspeaker and generating a current signal; and a signal processing unit, coupled to the current sensing unit and the driving circuit, for receiving an audio signal and generating the control signal, where the signal processing unit performs a signal processing on the current signal for determining whether a diaphragm excursion of the loudspeaker exceeds a displacement limit, and if the current signal shows that the diaphragm excursion is greater than the displacement limit, the driving voltage signal provided to the loudspeaker is decreased until the current signal shows that the diaphragm excursion is less than or equal to the displacement limit, and the current driving voltage signal, the current signal, the displacement limit, and an electrical impedance of the loudspeaker are substituted into a function to compute a force factor of the loudspeaker.

In one embodiment of the present invention, the signal processing performed by the signal processing unit is to observe if the oscillating amplitude of the second derivative of the current signal is greater than a predetermined value. If the oscillating amplitude is greater than the predetermined value, the diaphragm excursion of the loudspeaker is deemed to be greater than the displacement limit, where the predetermined value is positively related to the magnitude of the driving voltage signal.

In one embodiment of the present invention, the signal processing unit includes a digital signal processor (DSP) and a digital-to-analog converter (DAC). The DSP is coupled to the current sensing unit and receives the audio signal and the current signal. The DAC is coupled to the DSP and the driving circuit, where the control signal is generated by the DAC.

In one embodiment of the present invention, the current sensing unit includes a sensing circuit and an analog-to-digital converter (ADC). The sensing circuit is coupled to the loudspeaker and measures the current flowing through the loudspeaker. The ADC is coupled to the sensing circuit and the DSP and outputs the current signal.

In one embodiment of the present invention, the driving voltage is a sinusoid of a specified time period.

In one embodiment of the present invention, the sinusoid is selected from the group consisting of between 1 Hz and the resonance frequency of the loudspeaker, vicinity of the resonance frequency of the loudspeaker, and 100 Hz.

In one embodiment of the present invention, the specified time period is the cycle of the sinusoid or 10 milliseconds (ms).

In one embodiment of the present invention, the function is denoted by:

$$\Phi = \frac{|U(w) - Z_e(w) \cdot I(w)|}{|X(w)|},$$

where Φ is the force factor, U(w) is the expression of frequency domain of the driving voltage signal after being Laplace transformed, Ze(w) is the expression of frequency domain of the electrical impedance after being Laplace transformed, I(w) is the expression of frequency domain of the current signal after being Laplace transformed, and X(w) is the expression of frequency domain of the displacement limit after being Laplace transformed.

The advantageous effect of the present invention over conventional approaches is that the present method is able to accurately detect the force factor of the loudspeaker under normal operation and circumstances, and the method can be utilized by end users or be applied to the production testing after the loudspeaker being manufactured, thereby increasing applicability and convenience.

BRIEF DESCRIPTION OF DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE PREFERRED EMBODIMENTS

In the description hereinafter, the term of "coupled" or "coupling" refers to any two objects directly or indirectly electrically connected to each other. Therefore, if it is described that "a first device is coupled to a second device," the meaning is that the first device is either directly electrically connected to the second device or indirectly electrically connected to the second device through other devices or connection means.

Figure 1:
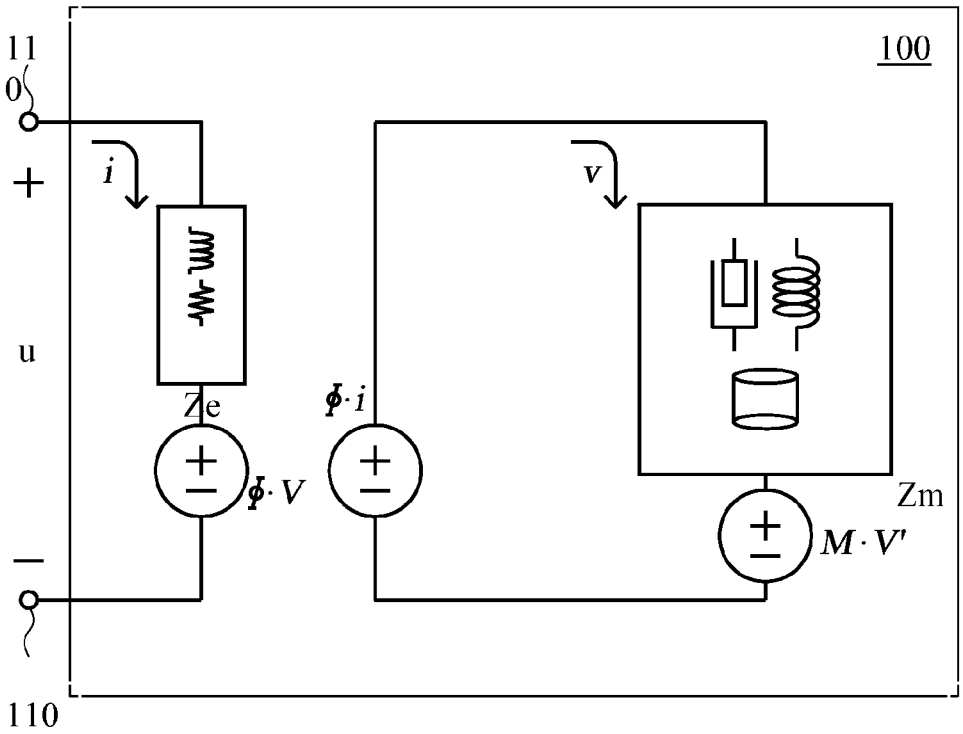
FIG. 1 (Prior art)
FIG. 1 is an equivalent circuit diagram of a prior-art loudspeaker.
Figure 2:
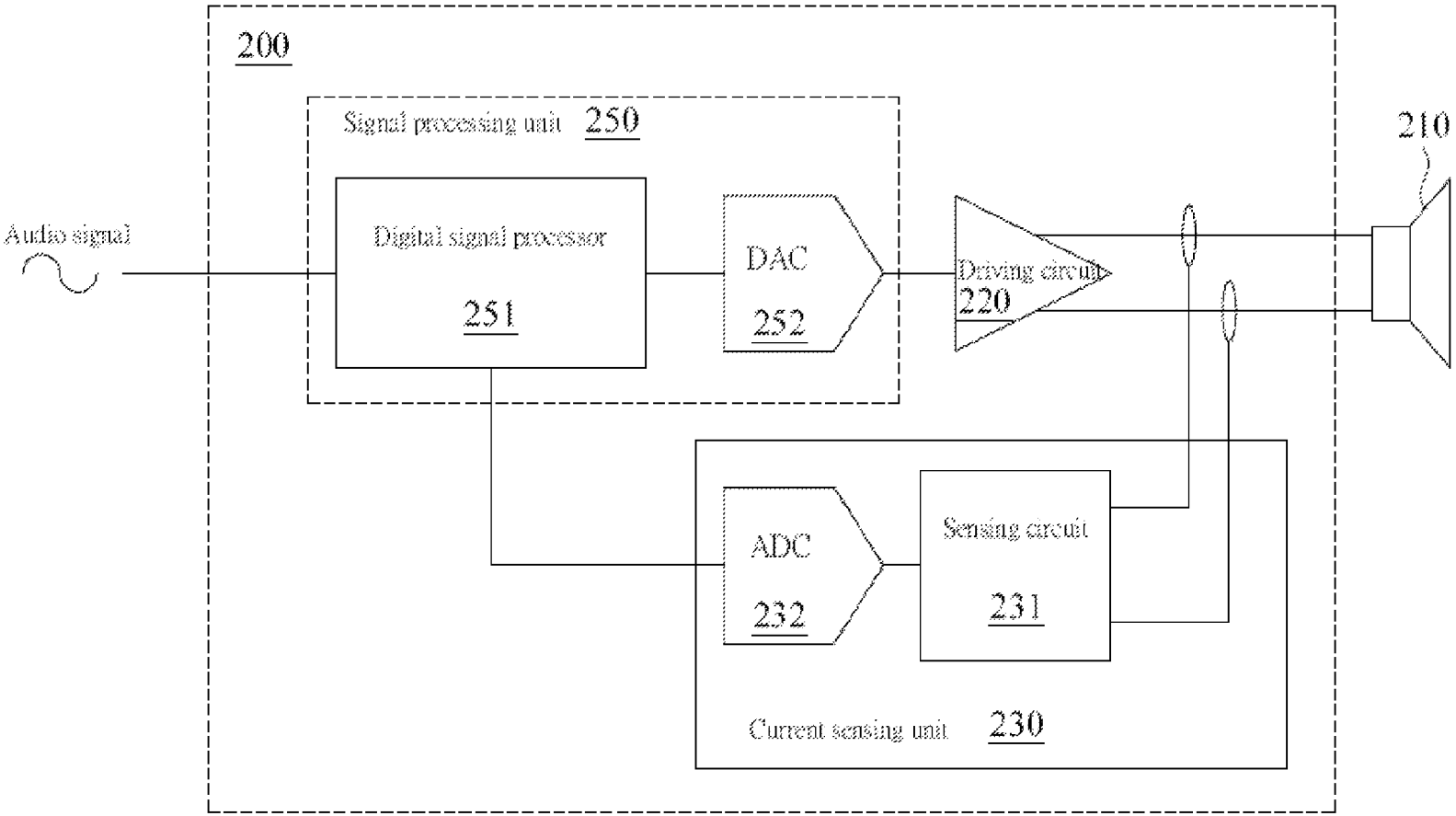
FIG. 2 is a circuit diagram of a device for detecting a force factor of a loudspeaker according to the first embodiment of the present invention.

FIG. 2 shows a circuit diagram of a device 200 for detecting a force factor of a loudspeaker according to the first embodiment of the present invention. The equivalent circuit of the loudspeaker 210 can be referred to FIG. 1 and its description. The device 200 for detecting the force factor includes a driving circuit 220, a current sensing unit 230, and a signal processing unit 250.

The driving circuit 220, coupled to the loudspeaker 210, receives a control signal generated from the signal processing unit and generates a dynamic driving voltage signal for driving the loudspeaker 210. For example, the dynamic driving voltage signal is a form of a sinusoid with a specified time period. The frequency of the sinusoid is either between the resonant frequency of the loudspeaker 210 and 1 Hz or vicinity of the resonant frequency of the loudspeaker 210. The frequency of the sinusoid can be set to a relatively lower frequency, for example, 100 Hz, if the detection operation is meant to be hidden from end users. When the device 200 for detecting the force factor is adopted in an electronic device, the signal gain curve of output SPL to the input driving voltage signal over the frequency domain is likely to have a second-order decay under 800 Hz, and therefore the detection operation of a driving voltage signal with 100 Hz sinusoid, because of grater decay on the output SPL, is subject to be hidden from end users, and the measured results are meaningful. In addition, the dynamic driving voltage signal can be associated with a specified time period, where a proper time period is determined based on the cycle of the said sinusoid. For example, when the frequency of the sinusoid is 100 Hz, the time period can be set to 10 ms, thus making the end user unaware of the sound wave for test purpose, where the sound wave is generated by the driving voltage signal.

The current sensing unit 230, coupled to the loudspeaker, continuously measures the current signal flowing through the loudspeaker 210 and generates a current signal, where the current is orderly sampled with multiple times based on a fixed time period such that the current signal with respect to time is collected.

The signal processing unit 250 is coupled to the current sensing unit 230 and the driving circuit 220. The signal processing unit 250 receives an audio signal and generates the control signal. The signal processing unit 250 performs a signal processing on the current signal for determining whether a diaphragm excursion of the loudspeaker 210 exceeds a displacement limit. If the current signal shows that the diaphragm excursion is greater than the displacement limit, the driving voltage signal provided to the loudspeaker 210 is decreased until the current signal shows that the diaphragm excursion is less than or equal to the displacement limit. Meanwhile, the current driving voltage signal, the current signal, the displacement limit, and an electrical impedance of the loudspeaker 210 are substituted into a function to compute a force factor of the loudspeaker 210.

The operating principle of the device 200 for detecting the force factor is detailed as follows. As indicated in FIG. 1, the magnitude of the BEMF is equal to the force factor Φ multiplied by the velocity of the displacement v of the diaphragm, and the diaphragm excursion is equal to the integral of the velocity of the displacement v over time. Therefore, the integral of the BEMF over time is positively related to the diaphragm excursion of the loudspeaker 210. Assume that the diaphragm excursion is x, the above-mentioned relation can be denoted by Eq. (2) as follows:

$$\Phi \cdot x = \int \Phi \cdot v \cdot dt \tag{2}$$

According to the aspect of the electrical property of the loudspeaker in FIG. 1, the magnitude of the BFMF is equal to the driving voltage u minus the voltage across the electrical impedance Ze, where the voltage across the electrical impedance Ze is equal to the current i multiplied by the electrical impedance Ze. Given the driving voltage u is known, as long as the electrical impedance Ze is known, one can compute the magnitude of the BEMF by measuring the current i. The above-mentioned relation can be denoted by Eq. (3) as follows:

$$\Phi \cdot x = \int \Phi \cdot v \cdot dt = \int (u - Z_e \cdot i) \cdot dt \tag{3}$$

After applying the Laplace transformation on two sides of Eq. (3) and taking absolute values, the function of the force factor Φ can be expressed by Eq. (4) as follows:

$$\Phi = \frac{|U(w) - Z_e(w) \cdot I(w)|}{|X(w)|}, \tag{4}$$

where U(w) is the expression of frequency domain of the driving voltage signal after being Laplace transformed, Ze(w) is the expression of frequency domain of the electrical impedance after being Laplace transformed, I(w) is the expression of frequency domain of the current signal after being Laplace transformed, and X(w) is the expression of frequency domain of the displacement limit after being Laplace transformed.

The electrical impedance Ze is known and can be obtained as follows. By measuring the current signal under a driving voltage signal of low frequency (i.e., under the circumstances that the diaphragm excursion is not too large, that is, the magnitude of the BEMF is not big.), the electrical impedance Ze can be computed by dividing the current signal by the driving voltage signal. According to Eq. (4), if the diaphragm excursion of the loudspeaker 210 is determined to be equal to the said displacement limit (i.e., |X(w)| of Eq. (4) is equal to a predetermined value.), one can obtain the force factor Φ by substituting the current driving voltage signal and the measured current signal into Eq. (4).

According to the practical physical effect of a loudspeaker, when the diaphragm excursion of the loudspeaker 210 is close to, or even greater than, the displacement limit, the current signal is inclined to form a non-continuous point at the signal peak. This effect, if referring to FIG. 1, accounts for a non-linear increasing of the saturation electromagnetic force M*v' when the diaphragm excursion increases. Since the current signal is inclined to form a non-continuous point at the signal peak, one can obtain a significant characteristic by performing a second derivative on the current signal.

Figure 3:
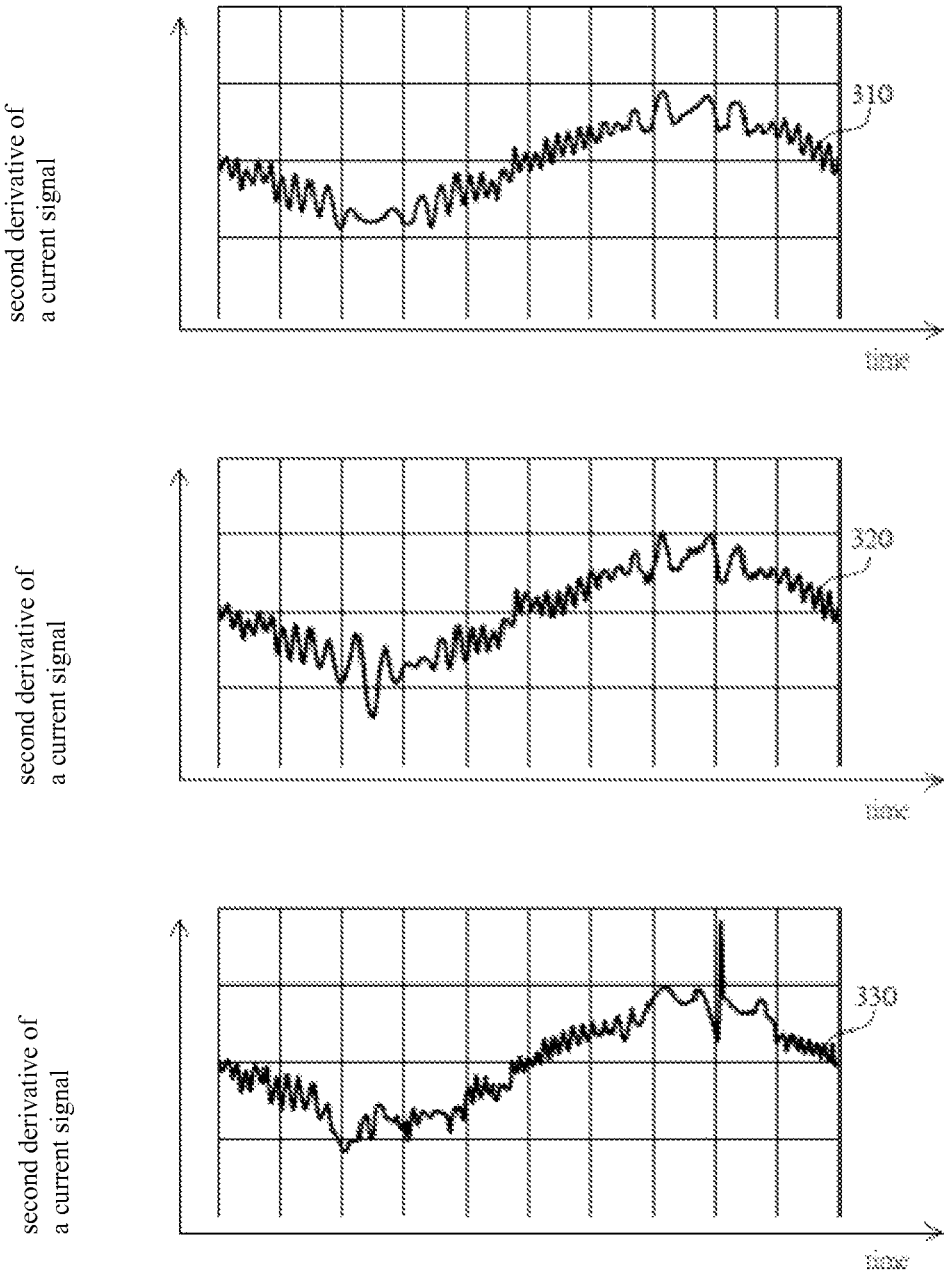
FIG. 3 is a waveform diagram showing the second derivative of a current signal according to the embodiment of the present invention shown in FIG. 2.

FIG. 3 illustrates a waveform diagram showing the second derivative of a current signal when the driving voltage signal is a sinusoid, where the waveforms 310, 320, and 330 respectively represent the case when the diaphragm excursion is less than the displacement limit, close to the displacement limit, and greater than the displacement limit. Note that the oscillating amplitude of the waveforms 310, 320, and 330 are adjusted to be exactly the same in magnitude. As indicated in FIG. 3, there exists some significant protrusion at the signal foot on the waveform 320, and there exists much significant protrusion at the signal peak on the waveform 330. Therefore, the significant characteristic of the current signal over the time domain can be used to determine the diaphragm excursion of the loudspeaker. That is, one can determine that the diaphragm excursion of the loudspeaker exceeds the displacement limit if the oscillating amplitude of the second derivative of the current signal is greater than a predetermined value, where the predetermined value is positively related to the magnitude of the driving voltage signal. Compared with the prior-art approaches that use the THD to determine the diaphragm excursion, which may not be distinguishable, the present invention that determines the significant protrusions at the signal foot of and at the signal peak, as indicated in the waveforms 320 and 330, provides a more distinguishable approach.

In addition, as shown in FIG. 2, the signal processing unit 250 further includes a DSP 251 and a DAC 252. The DSP 251 is coupled to the current sensing unit 230 and receives an audio signal and a current signal. The DAC 252 is coupled to the DSP 251 and the driving circuit 220 and generates a control signal. The implementation for the circuit of the DSP 251 and the DAC 252 is known by persons ordinarily skilled in the art.

Furthermore, as shown in FIG. 2, the current sensing unit 230 includes a sensing circuit 231 and an ADC 232. The sensing circuit 231 is coupled to the loudspeaker 210 and used to measure the current flowing through the loudspeaker 210. The ADC 232 is coupled to the sensing circuit 231 and the signal processing unit 250 and used to output the current signal. Likewise, the implementation for the circuit of the sensing circuit 231 and the ADC 232 is known by persons ordinarily skilled in the art.

Figure 4:
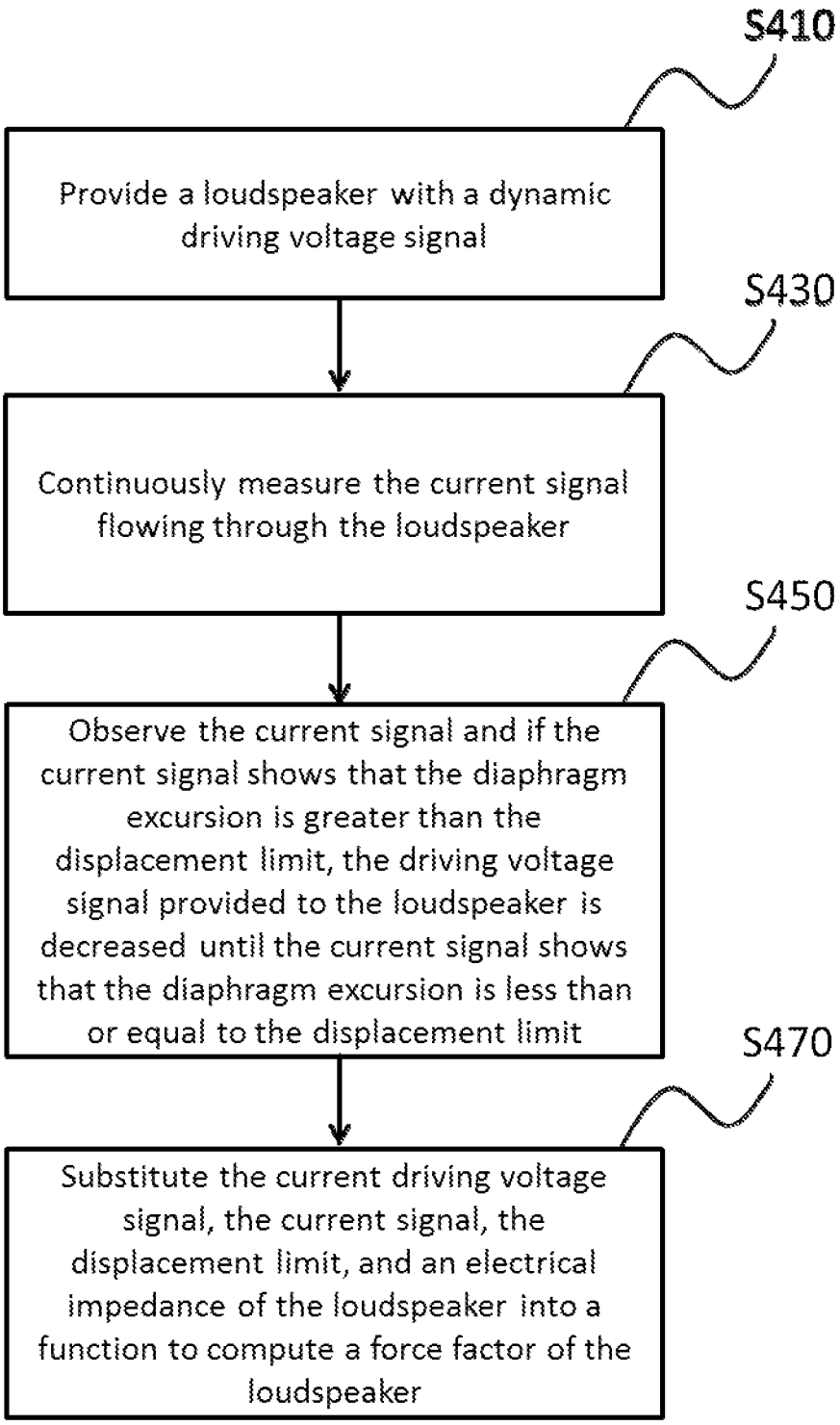
FIG. 4 is a flowchart of a method for detecting a force factor of a loudspeaker according to the second embodiment of the present invention.

FIG. 4 is a flowchart of a method for detecting a force factor of a loudspeaker according to the second embodiment of the present invention. The steps of the method are described as follows:

In step S410, provide a loudspeaker with a dynamic driving voltage signal. The dynamic driving voltage signal, for example, may be a form of a sinusoid with a specified time period, where the frequency of the sinusoid is either between the resonant frequency of the loudspeaker 210 and 1 Hz or vicinity of the resonance frequency of the loudspeaker 210. The frequency of the sinusoid can be set to a relatively lower frequency, for example, 100 Hz, if the detection operation is meant to be hidden from end users. A proper time period is determined based on the cycle of the said sinusoid. For example, when the frequency of the sinusoid is 100 Hz, the time period can be set to 10 ms, thus making the end users unaware of the sound wave for test purpose, where the sound wave is generated by the driving voltage signal.

In step S430, continuously measure the current signal flowing through the loudspeaker 210.

In step S450, observe the current signal and if the current signal shows that the diaphragm excursion is greater than the displacement limit, the driving voltage signal provided to the loudspeaker 210 is decreased until the current signal shows that the diaphragm excursion is less than or equal to the displacement limit.

In step S470, substitute the current driving voltage signal, the current signal, the displacement limit, and an electrical impedance of the loudspeaker 210 into a function to compute a force factor of the loudspeaker 210. The function can be referred to Eq. (4) and the description thereof.

Figure 5:
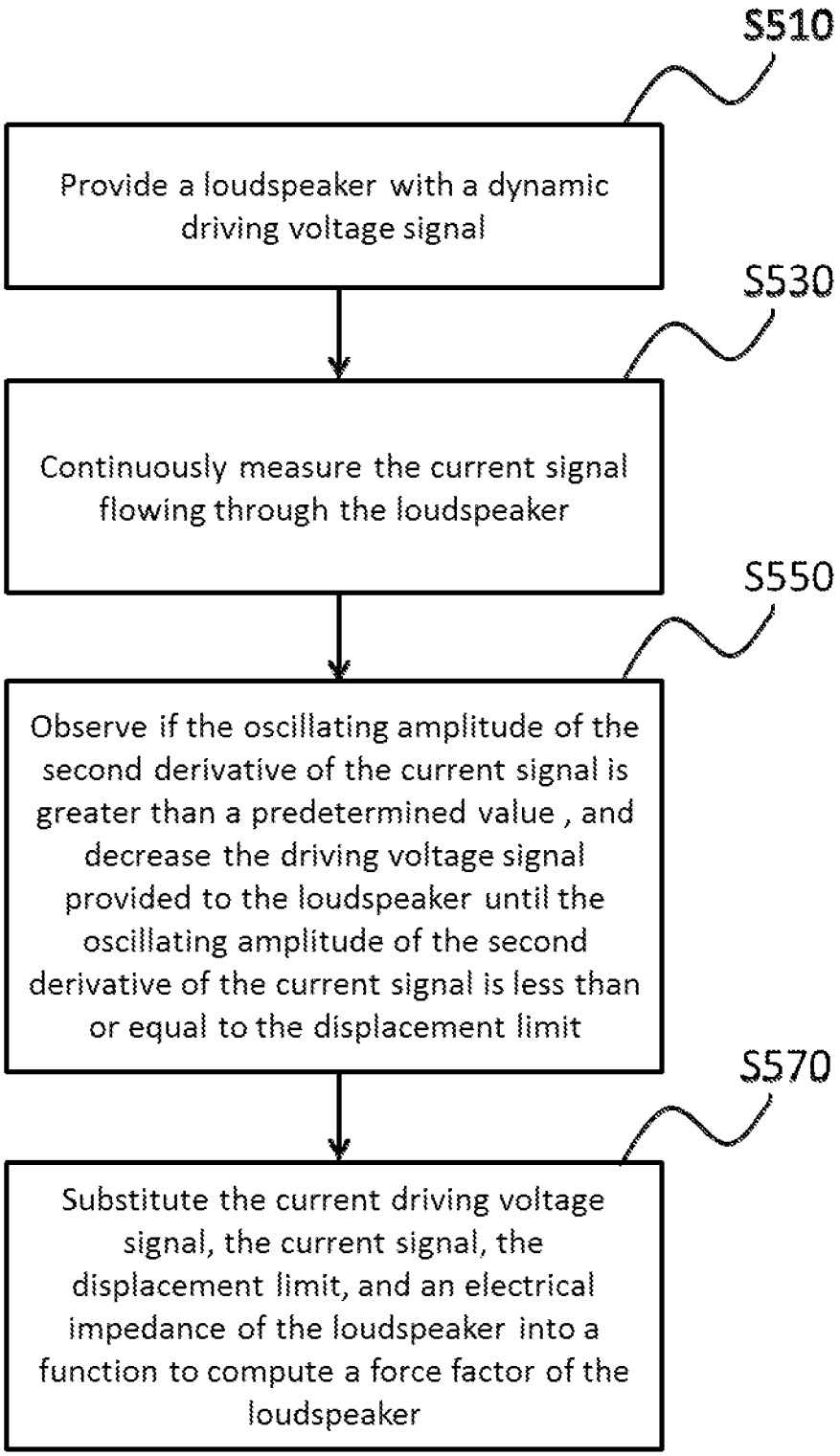
FIG. 5 is a flowchart of a method for detecting a force factor of a loudspeaker according to the third embodiment of the present invention.

FIG. 5 is a flowchart of a method for detecting a force factor of a loudspeaker according to the third embodiment of the present invention. The steps of the method are described as follows:

The description of steps S510, S530, and S570 can be referred to the description of steps S410, S420, and S470 respectively, according to the second embodiment shown in FIG. 4.

In step S550, observe if the oscillating amplitude of the second derivative of the current signal is greater than a predetermined value and if the oscillating amplitude is greater than the predetermined value, which the diaphragm excursion of the loudspeaker is deemed to be greater than the displacement limit, decrease the driving voltage signal provided to the loudspeaker 210 until the oscillating amplitude of the second derivative of the current signal is less than or equal to the displacement limit, where the predetermined value is positively related to the magnitude of the driving voltage signal.

It should be noted that all embodiments of the present invention disclosed can be adopted to detect and calibrate the force factor for the mass production test in a loudspeaker factory. In addition, the embodiments of the present invention disclosed allow the end user to perform a foreground detection for the force factor, without introducing perceivable noise, and to calibrate the force factor of a loudspeaker every time when the loudspeaker is powered on. Therefore, the present invention provides flexible applicability and convenience in use.

The foregoing embodiments are illustrative of the characteristics of the present invention to enable a person skilled in the art to understand the disclosed subject matter and implement the present invention accordingly. The embodiments, however, are not intended to restrict the scope of the present invention. Hence, all equivalent modifications and variations made in the foregoing embodiments without departing from the spirit and principles of the present invention should fall within the scope of the appended claims.

What is claimed is:

1. A method for detecting a force factor of a loudspeaker, comprising the steps of:

outputting a dynamic driving voltage signal to a loudspeaker;

continuously measuring a current signal flowing through said loudspeaker;

observing said current signal, and if said current signal shows that a diaphragm excursion of said loudspeaker exceeds a displacement limit, decreasing said driving voltage signal provided to said loudspeaker until said current signal showing that said diaphragm excursion is less than or equal to said displacement limit; and meanwhile, substituting said driving voltage signal, said current signal, said displacement limit, and an electrical impedance of said loudspeaker into a function in order to derive a force factor of said loudspeaker.

2. The method for detecting a force factor as of claim 1, wherein the step of observing said current signal further comprises observing if an oscillating amplitude of the second derivative of said current signal is greater than a predetermined value, and if said oscillating amplitude is greater than the predetermined value, said diaphragm excursion of said loudspeaker is deemed to be greater than said displacement limit, where said predetermined value is positively related to the magnitude of said driving voltage signal.

3. The method for detecting a force factor as of claim 1, wherein said driving voltage signal is a sinusoid of a specified time period.

4. The method for detecting a force factor as of claim 3, wherein the frequency of said sinusoid is selected from the group consisting of between the resonant frequency of said loudspeaker and 1 Hz, the vicinity of the resonant frequency of said loudspeaker, and a 100 Hz.

5. The method for detecting a force factor as of claim 3, wherein said specified time period is a cycle of said sinusoid or a 10 ms.

6. The method of detecting a force factor as of claim 1, wherein said function is calculated by:

$$\Phi = \frac{|U(w) - Z_e(w) \cdot I(w)|}{|X(w)|},$$

wherein Φ is said force factor, U(w) is the expression of frequency domain of said driving voltage signal after being transformed by a Laplace transformation, Ze(w) is the expression of frequency domain of said electrical impedance after being transformed by a Laplace transformation, I(w) is the expression of frequency domain of said current signal after being transformed by a Laplace transformation, and X(w) is the expression of frequency domain of said displacement limit after being transformed by a Laplace transformation.

7. The method for detecting a force factor as of claim 2, wherein said driving voltage signal is a sinusoid of a specified time period.

8. The method of detecting a force factor as of claim 2, wherein said function is calculated by:

$$\Phi = \frac{|U(w) - Z_e(w) \cdot I(w)|}{|X(w)|},$$

wherein Φ is said force factor, U(w) is the expression of frequency domain of said driving voltage signal after being transformed by a Laplace transformation, Ze(w) is the expression of frequency domain of said electrical impedance after being transformed by a Laplace transformation, I(w) is the expression of frequency domain of said current signal after being transformed by a Laplace transformation, and X(w) is the expression of frequency domain of said displacement limit after being transformed by a Laplace transformation.

9. A device for detecting a force factor of a loudspeaker, comprising:

a driving circuit, coupled to a loudspeaker, for receiving a control signal and generating a dynamic driving voltage signal;

a current sensing unit, coupled to said loudspeaker, for continuously measuring a current flowing through said loudspeaker and generating a current signal; and a signal processing unit coupled to said current sensing unit and said driving circuit, said signal processing unit receiving an audio signal so as to generate said control signal, said signal processing unit performing a signal processing on said current signal such that said processing unit determines whether a diaphragm excursion of said loudspeaker exceeds a displacement limit, and if said current signal shows that said diaphragm excursion is greater than the displacement limit, decreasing said driving voltage signal provided to said loudspeaker until said current signal showing that said diaphragm excursion is less than or equal to said displacement limit, and meanwhile, substituting said driving voltage signal, said current signal, said displacement limit, and an electrical impedance of said loudspeaker into a function in order to derive a force factor of said loudspeaker.

10. The device for detecting a force factor as of claim 9, wherein said signal processing is to observe if an oscillating amplitude of the second derivative of said current signal is greater than a predetermined value, and if said oscillating amplitude being greater than the predetermined value, said diaphragm excursion of said loudspeaker is deemed to be greater than said displacement limit, where said predetermined value is positively related to the magnitude of said driving voltage signal.

11. The device for detecting a force factor as of claim 9, wherein said signal processing unit includes a digital signal processor (DSP) and a digital-to-analog converter (DAC), said DSP being coupled to said current sensing unit and receiving said audio signal and said current signal, said DAC being coupled to said DSP and said driving circuit and generating said control signal.

12. The device for detecting a force factor as of claim 9, wherein said current sensing unit includes a sensing circuit and an analog-to-digital converter (ADC), said sensing circuit, coupled to said loudspeaker, for measuring said current flowing through said loudspeaker, said ADC being coupled to said sensing circuit and said DSP and generating said current signal.

13. The device for detecting a force factor as of claim 9, wherein said driving voltage signal is a sinusoid of a specified time period.

14. The device for detecting a force factor as of claim 13, wherein the frequency of said sinusoid is selected from the group consisting of between the resonant frequency of said loudspeaker and 1 Hz, the vicinity of the resonant frequency of said loudspeaker, and a 100 Hz.

15. The device for detecting a force factor as of claim 13, wherein said specified time period is a cycle of said sinusoid or a 10 ms.

16. The device for detecting a force factor as of claim 9, wherein said function is calculated by:

$$\Phi = \frac{|U(w) - Z_e(w) \cdot I(w)|}{|X(w)|},$$

wherein Φ is said force factor, U(w) is the expression of frequency domain of said driving voltage signal after being transformed by a Laplace transformation, Ze(w) is the expression of frequency domain of said electrical impedance after being transformed by a Laplace transformation, I(w) is the expression of frequency domain of said current signal after being transformed by a Laplace transformation, and X(w) is the expression of frequency domain of said displacement limit after being transformed by a Laplace transformation.

17. The device for detecting a force factor as of claim 10, wherein said driving voltage signal is a sinusoid of a specified time period.

18. The device for detecting a force factor as of claim 11, wherein said driving voltage signal is a sinusoid of a specified time period.

19. The device for detecting a force factor as of claim 12, wherein said driving voltage signal is a sinusoid of a specified time period.

20. The device of detecting a force factor as of claim 10, wherein said function is calculated by:

$$\Phi = \frac{|U(w) - Z_e(w) \cdot I(w)|}{|X(w)|},$$

wherein Φ is said force factor, U(w) is the expression of frequency domain of said driving voltage signal after being transformed by a Laplace transformation, Ze(w) is the expression of frequency domain of said electrical impedance after being transformed by a Laplace transformation, I(w) is the expression of frequency domain of said current signal after being transformed by a Laplace transformation, and X(w) is the expression of frequency domain of said displacement limit after being transformed by a Laplace transformation.

* * * * *